US011889882B2

(12) United States Patent
Liu et al.

(10) Patent No.: US 11,889,882 B2
(45) Date of Patent: Feb. 6, 2024

(54) HELMET

(71) Applicant: JIANGMEN PENGCHENG HELMETS LTD., Guangdong (CN)

(72) Inventors: Xinsheng Liu, Heshan (CN); Hanlin Wan, Heshan (CN); Xing Cheng, Heshan (CN)

(73) Assignee: JIANGMEN PENGCHENG HELMETS LTD., Heshan (CN)

( * ) Notice: Subject to any disclaimer, the term of this patent is extended or adjusted under 35 U.S.C. 154(b) by 194 days.

(21) Appl. No.: 17/697,342

(22) Filed: Mar. 17, 2022

(65) Prior Publication Data

US 2023/0157402 A1 May 25, 2023

(30) Foreign Application Priority Data

Nov. 25, 2021 (CN) ..... 202122942401.7

(51) Int. Cl.
*A42B 3/32* (2006.01)
*A42B 3/04* (2006.01)

(52) U.S. Cl.
CPC ..... *A42B 3/326* (2013.01); *A42B 3/04* (2013.01)

(58) Field of Classification Search
CPC .. A42B 3/326; A42B 3/04; A42B 3/32; A42B 3/20; A42B 3/222; A42B 3/228
See application file for complete search history.

(56) References Cited

U.S. PATENT DOCUMENTS

| | | | | | |
|---|---|---|---|---|---|
| 3,478,365 | A * | 11/1969 | Varga | A42B 3/08 | 2/424 |
| 3,886,596 | A * | 6/1975 | Franklin | A61F 9/02 | 2/9 |
| 4,885,806 | A * | 12/1989 | Heller | A42B 3/326 | 2/424 |
| 5,263,204 | A * | 11/1993 | Butsch | A42B 3/326 | 2/9 |
| 9,700,096 | B2 * | 7/2017 | McGinn | A42B 3/326 | |
| 11,134,742 | B2 * | 10/2021 | Ferrari | A63B 71/10 | |
| 2020/0146386 | A1 * | 5/2020 | Schmidt | A42B 3/324 | |
| 2021/0274877 | A1 * | 9/2021 | Liao | A42B 3/205 | |

* cited by examiner

*Primary Examiner* — Tajash D Patel
*Assistant Examiner* — Tejash Patel
(74) *Attorney, Agent, or Firm* — MYERS WOLIN, LLC

(57) ABSTRACT

A helmet is disclosed including: a helmet body; a jaw guard with two fork handles through which the jaw guard is mounted on the helmet body and rotatable around a fixed axis relative to the helmet body; a shield assembly including a shield and a bracket, which is movable between a lowered position and a raised position relative to the helmet body; and a lifting mechanism including a trigger located beside the bracket of the shield assembly and driven by the fork handles of the jaw guard, and the trigger can touch the bracket of the shield assembly at the lowered position and raise the shield assembly from the lowered position. The lifting mechanism further includes an elastic element with one end connected with the bracket, which is arranged to make the shield assembly continue to move to the raised position after the shield assembly leaves the lowered position.

21 Claims, 14 Drawing Sheets

HELMET

CROSS-REFERENCE TO RELATED APPLICATION

This application is based on and claims the benefit of priority from Chinese Patent Application No. 202122942401.7, filed on 25 Nov. 2021, the entirety of which is incorporated by reference herein.

TECHNICAL FIELD

The disclosure relates to the technical field of human body safety protection appliances, and more particularly, to a helmet.

BACKGROUND

Workers who work in many special occasions, such as a spraying workshop, fire-fighting, disaster-relief, anti-terrorism and anti-riot occasions, underground tunnel operation environments including mining, coal mining and tunnelling, and driving environments in a motor vehicle, a racing car and an aircraft, must wear helmets to protect their heads. A typical helmet generally includes a helmet shell body, a shield and a jaw guard, wherein the shield and the jaw guard are both mounted on the helmet body, and the shield may be lifted or lowered relative to the helmet body according to the needs. The shield is made of a transparent material, which can prevent harmful particles such as dust, rain and smoke from invading, and can especially prevent branches, flying stones and even explosives from harming eyelids. The jaw guard can effectively protect important organs such as a chin, a nose, a mouth and cheeks of a wearer in the case of collision or other events.

In fact, during wearing and using of the helmet, it is often necessary to lift the shield every now and then, so as to communicate with the outside world, or to dissipate water mist generated by breathing of a driver and accumulated inside the helmet. For those helmets with a variable jaw guard, there is another meaning for lifting the shield, which is to prevent the shield from colliding with the jaw guard, that is, the lifting of the shield must be matched and correlated with an operating state of the jaw guard. In other words, when a state of the jaw guard is switched between a full helmet structure and a half helmet structure, the shield must be located at a lifted position at a right time, so as to avoid the jaw guard from colliding with the shield in a lowered state to be damaged when returning to a full helmet position.

In the related technology, existing helmets can be switched between the full helmet and the half helmet, but for most of the helmets, the shield and the jaw guard rotate around a fixed axis. In order to ensure that the jaw guard can be rotated to a rear side of the helmet, a space should be reserved between the jaw guard and the shield, which requires that the helmet should be manufactured in a large size, resulting in the helmet being bulky as a whole. During rotation, due to a small space reserved between the jaw guard and the shield, the jaw guard and the shield are easy to get stuck when the helmet is switched between the full helmet and the half helmet.

SUMMARY

The disclosure aims to solve at least one of the technical problems in the existing technology. Therefore, the disclosure provides a helmet, which can reduce a size of a jaw guard, and can be better switched between the full helmet and the half helmet.

The disclosure also provides another helmet.

A helmet according to an embodiment in a first aspect of the disclosure includes:

- a helmet body;
- a jaw guard, wherein the jaw guard is provided with two fork handles, the jaw guard is mounted on the helmet body through the two fork handles and is rotatable around a fixed axis relative to the helmet body, and the jaw guard is movable between a closed position in front of the helmet body and an open position behind the helmet body and beyond a vertex of the helmet body;
- a shield assembly movably mounted on the helmet body, wherein the shield assembly is movable between a lowered position and a raised position relative to the helmet body, and the shield assembly includes a shield and brackets arranged at two sides of the shield; and
- a lifting mechanism, wherein the lifting mechanism includes:
  - a guide plate, wherein the guide plate is mounted on the helmet body, or the guide plate and the helmet body are manufactured in an integrated structure, the guide plate is configured for guiding and limiting movement of the shield assembly, and the guide plate and the bracket are provided with respective guide assemblies which are matched with each other;
  - a gearwheel, wherein the gearwheel is mounted on one of the fork handles of the jaw guard, or the gearwheel and the fork handle on the jaw guard are manufactured in an integrated structure, and the gearwheel is rotatable with the jaw guard; and
  - a pinion engaged with the gearwheel, wherein the pinion is provided with a trigger, and the trigger is located beside the bracket of the shield assembly at the lowered position no matter the jaw guard is located at the closed position or the open position;
- wherein, at an initial movement stage of switching the jaw guard from the closed position to the open position or switching the jaw guard from the open position to the closed position, the gearwheel drives the pinion to rotate, and the trigger is capable of touching the bracket of the shield assembly at the lowered position and raising the shield assembly from the lowered position.

The helmet according to the embodiment of the disclosure at least has the following beneficial effects.

The helmet includes the helmet body, the jaw guard, the shield assembly and the lifting mechanism, wherein the jaw guard is provided with two fork handles, the two fork handles are respectively mounted at two sides of the helmet body, and the jaw guard is mounted on the helmet body through the two fork handles and is rotatable around a fixed axis relative to the helmet body, so that the jaw guard is movable between the closed position in front of the helmet body and the open position behind the helmet body and beyond the vertex of the helmet body; the shield assembly includes the shield and the brackets arranged at two sides of the shield, the shield assembly is movably mounted on the helmet body, and the shield assembly is movable between the lowered position and the raised position relative to the helmet body; and the lifting mechanism includes the guide plate, the gearwheel and the pinion, wherein the guide plate is mounted on the helmet body, or the guide plate and the helmet body are manufactured in the integrated structure, the guide plate is configured for guiding and limiting the movement of the shield assembly, and the guide plate and the bracket are provided with the respective guide assemblies which are matched with each other, so that the whole shield assembly is movable along a designed path of the guide plate; the gearwheel is mounted on the fork handle of the jaw guard, the jaw guard is fixedly connected with the gearwheel, or the gearwheel and the fork handle on the jaw guard are manufactured in the integrated structure, and the gearwheel is rotatable with the jaw guard; the pinion is engaged with the gearwheel, so that rotation of the gearwheel drives rotation of the pinion, the pinion is provided with the trigger, and the trigger is located beside the bracket of the shield assembly at the lowered position no matter the jaw guard is located at the closed position or the open position; at the initial movement stage of switching the jaw guard from the closed position to the open position and switching the jaw guard from the open position to the closed position, the gearwheel drives the pinion to rotate, and the trigger is capable of touching the bracket of the shield assembly at the lowered position and raising the shield assembly from the lowered position, so that the shield assembly rotates along a fixed path, and the jaw guard rotates around a fixed axis, thus avoiding interference between the shield assembly and the jaw guard during rotation, and switching the helmet from the full helmet to the half helmet.

In some embodiments of the disclosure, the gearwheel and the pinion are internally engaged.

In some embodiments of the disclosure, the gearwheel and the pinion are externally engaged.

In some embodiments of the disclosure, the gearwheel and the pinion are both rotatable around a fixed axis relative to the helmet body.

In some embodiments of the disclosure, when the jaw guard is switched from the closed position to the open position, a forward rotation angle of the pinion is greater than or equal to 270°; and when the jaw guard is switched from the open position to the closed position, a reverse rotation angle of the pinion is greater than or equal to 270°.

In some embodiments of the disclosure, the trigger is at least one deflector rod.

In some embodiments of the disclosure, the guide assembly includes a guide post and a guide groove matched with each other, and the guide post and the guide groove are respectively mounted on the guide plate and the bracket.

In some embodiments of the disclosure, the guide plate and the bracket located at the same side of the helmet body are provided with two sets of guide assemblies.

In some embodiments of the disclosure, the guide groove of at least one set of guide assemblies is set as V-shaped groove or arc-shaped groove.

In some embodiments of the disclosure, the lifting mechanism further includes an elastic element, one end of the elastic element is connected with the bracket, and the elastic element is configured to make the shield assembly continue to move to the raised position after the shield assembly leaves the lowered position.

In some embodiments of the disclosure, the elastic element is a tension spring.

In some embodiments of the disclosure, the bracket is provided with a draw hook for hooking the tension spring.

In some embodiments of the disclosure, the gearwheel is arranged on a turntable, and the turntable is fixedly mounted on the fork handle.

In some embodiments of the disclosure, the lifting mechanism further includes a chassis cover for covering the lifting mechanism, and the chassis cover is fixedly connected with the fork handle.

In some embodiments of the disclosure, the jaw guard is provided with a first limiting portion, the helmet body is provided with a second limiting portion, and the second limiting portion is matched with the first limiting portion for limiting a rotation position of the jaw guard relative to the helmet body.

In some embodiments of the disclosure, the first limiting portion is one of a bulge and a groove, and the second limiting portion is the other of the bulge and the groove.

A helmet according to an embodiment in a second aspect of the disclosure includes:

a helmet body;

a jaw guard, wherein the jaw guard is provided with two fork handles, the jaw guard is mounted on the helmet body through the two fork handles and is rotatable around a fixed axis relative to the helmet body, and the jaw guard is movable between a closed position in front of the helmet body and an open position behind the helmet body and beyond a vertex of the helmet body;

a shield assembly, wherein the shield assembly includes a shield and brackets arranged at two sides of the shield, an end portion of the bracket far away from the shield is hinged on the helmet body, the shield assembly is rotatable around a hinged position, and the shield assembly is movable between a lowered position and a raised position relative to the helmet body; and a lifting mechanism, wherein the lifting mechanism includes a trigger, and the trigger is located beside the bracket of the shield assembly at the lowered position no matter the jaw guard is located at the closed position or the open position;

wherein, at an initial movement stage of switching the jaw guard from the closed position to the open position or switching the jaw guard from the open position to the closed position, the trigger is capable of touching the bracket of the shield assembly at the lowered position and raising the shield assembly from the lowered position.

The helmet according to the embodiment of the disclosure at least has the following beneficial effects.

The helmet includes the helmet body, the jaw guard, the shield assembly and the lifting mechanism, wherein the jaw guard is provided with two fork handles, the two fork handles are respectively mounted at two sides of the helmet body, the jaw guard is mounted on the helmet body through the two fork handles and is rotatable around a fixed axis relative to the helmet body, so that the jaw guard is movable between the closed position in front of the helmet body and the open position behind the helmet body and beyond the vertex of the helmet body; the shield assembly includes the shield and the brackets arranged at two sides of the shield, the end portion of the bracket far away from the shield is hinged on the helmet body, the shield assembly is rotatable around the hinged position, and the shield assembly moves between the lowered position and the raised position relative to the helmet body; and the lifting mechanism includes the trigger, and the trigger is located beside the bracket of the shield assembly at the lowered position no matter the jaw guard is located at the closed position or the open position; at the initial movement stage of switching the jaw guard from the closed position to the open position and switching the jaw guard from the open position to the closed position, the trigger is capable of touching the bracket of the shield assembly at the lowered position and raising the shield assembly from the lowered position, thus switching the helmet from the full helmet to the half helmet.

In some embodiments of the disclosure, the trigger is a deflector rod.

In some embodiments of the disclosure, the lifting mechanism further includes an elastic element, one end of the elastic element is connected with the bracket, and the elastic element is configured to make the shield assembly continue to move to the raised position after the shield assembly leaves the lowered position.

In some embodiments of the disclosure, the elastic element is a tension spring.

In some embodiments of the disclosure, the bracket is provided with a draw hook for hooking the tension spring.

The additional aspects and advantages of the disclosure will be partially provided in the following description, and will partially be apparent in the following description, or learned by practice of the disclosure.

BRIEF DESCRIPTION OF THE DRAWINGS

The disclosure is further described hereinafter with reference to the drawings and the embodiments, wherein.

REFERENCE NUMERALS

Figure 1:
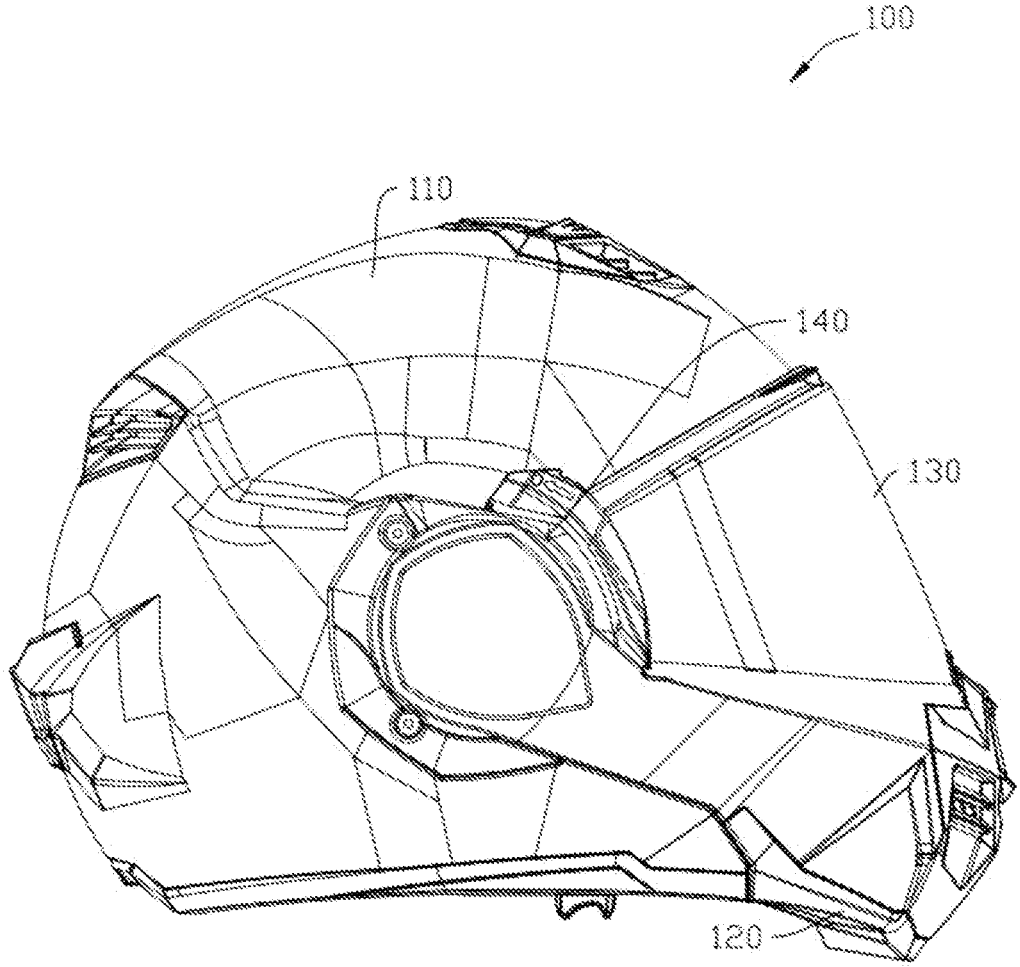
FIG. 1 is a schematic structural diagram of a helmet according to an embodiment of the disclosure.

100 refers to helmet;

110 refers to helmet body; 120 refers to jaw guard; 121 refers to fork handle; 130 refers to shield assembly; 131 refers to shield; 132 refers to bracket; 140 refers to lifting mechanism; 141 refers to guide plate; 142 refers to gearwheel; 143 refers to pinion; 1431 refers to trigger; 1411 refers to first guide post; 1412 refers to second guide post; 1413 refers to first guide groove; 1414 refers to second guide groove; 144 refers to elastic element; 1441 refers to draw hook; 1421 refers to turntable; 145 refers to chassis cover; 1201 refers to first limiting portion; and 1101 refers to second limiting portion.

DETAILED DESCRIPTION

The embodiments of the disclosure are described in detail hereinafter, and examples of the embodiments are shown in the drawings, wherein the same or similar reference numerals throughout the drawings denote the same or similar elements or elements having the same or similar functions. The embodiments described hereinafter with reference to the drawings are exemplary, and are only used to explain the disclosure, but should not be understood as limiting the disclosure.

In the description of the disclosure, it should be understood that the orientations or positional relationships indicated by the terms such as "upper", "lower" and the like, refer to the orientations or positional relationships shown in the drawings, which are only intended to facilitate describing the disclosure and simplifying the description, and do not indicate or imply that the indicated devices or elements must have a specific orientation, be constructed and operated in a specific orientation, and therefore cannot be understood as a limitation of the disclosure.

In the description of the disclosure, the term "a plurality of" refers to being two or more. If there are descriptions of "first" and "second", it is only for the purpose of distinguishing between technical features, and should not be understood as indicating or implying relative importance, implicitly indicating the number of the indicated technical features or implicitly indicating the order of the indicated technical features.

In the description of the disclosure, the terms "arrangement", "installation", "connection" and the like should be understood in broad sense unless otherwise specified and defined. The specific meanings of the above terms in the disclosure may be reasonably determined according to specific contents of the technical solutions by those of ordinary skills in the art.

Figure 2:
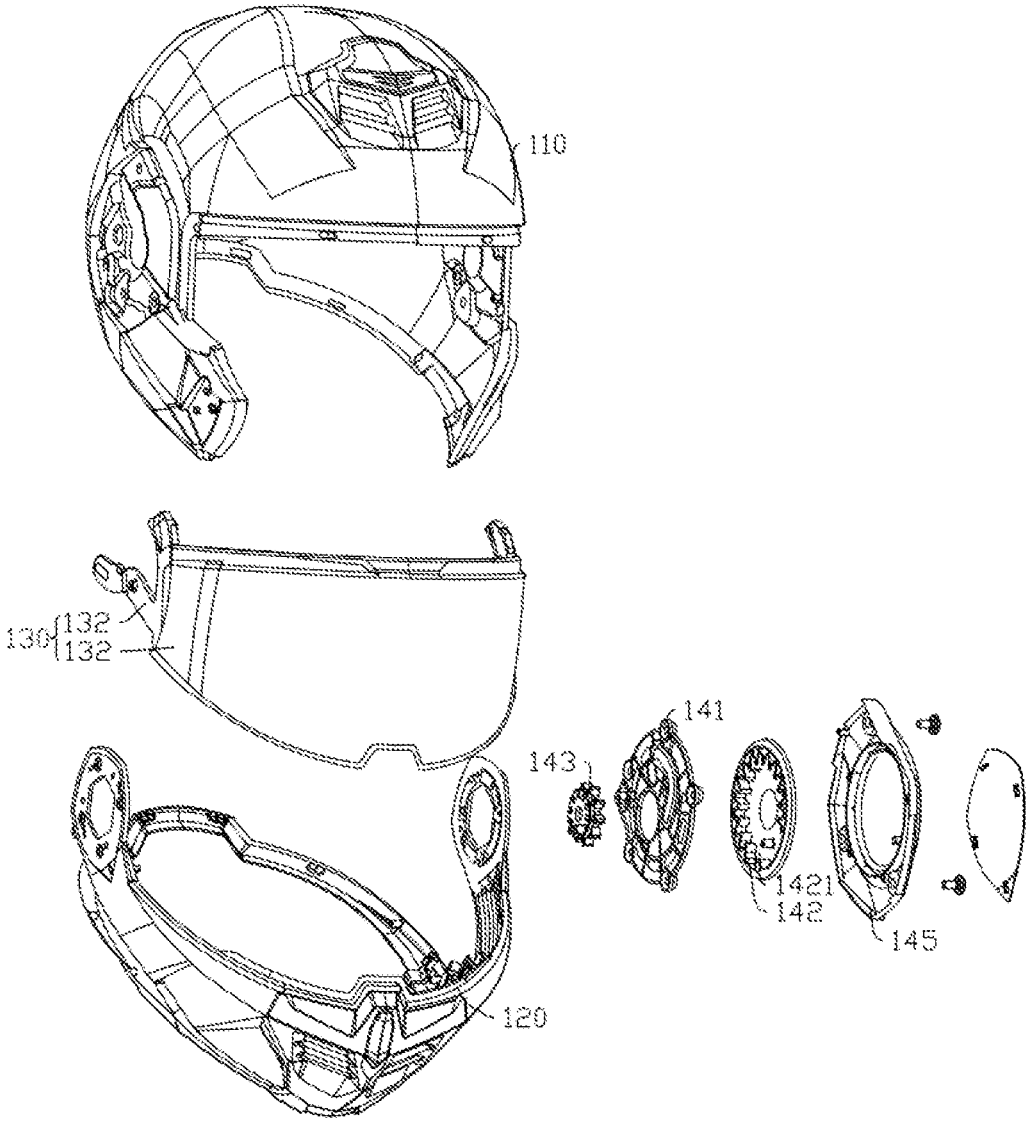
FIG. 2 is a partial exploded view of the helmet in FIG. 1.

With reference to FIG. 1 and FIG. 2, an embodiment in a first aspect of the disclosure provides a helmet 100, which includes: a helmet body 110, a jaw guard 120, a shield assembly 130 and a lifting mechanism 140. The jaw guard 120 is provided with two fork handles 121, the two fork handles 121 are respectively mounted at two sides of the helmet body 110, and the jaw guard 120 is mounted on the helmet body 110 through the two fork handles 121 and is rotatable around a fixed axis relative to the helmet body 110, so that the jaw guard 120 is movable between a closed position in front of the helmet body 110 and an open position behind the helmet body 110 and beyond a vertex of the helmet body 110. The shield assembly 130 includes a shield 131 and brackets 132 arranged at two sides of the shield 131. It should be noted that the shield 131 herein is made of a transparent material, and can prevent rainwater and dust from invading into the helmet body 110 in the case of driving. The shield assembly 130 is movably mounted on the helmet body 110, and the shield assembly 130 is movable between a lowered position and a raised position relative to the helmet body 110. The lifting mechanism 140 includes a guide plate 141, a gearwheel 142 and a pinion 143. The guide plate 141 is mounted on the helmet body 110, the guide plate 141 is configured for guiding and limiting movement of the shield assembly 130, and the guide plate 141 and the bracket 132 are provided with respective guide assemblies which are matched with each other, so that the whole shield assembly 130 is movable along a designed path of the guide plate 141. The gearwheel 142 is mounted on the fork handle 121 of the jaw guard 120, the jaw guard 120 is fixedly connected with the gearwheel 142, and the gearwheel 142 rotates with the jaw guard 120. The pinion 143 is engaged with the gearwheel 142, so that rotation of the gearwheel 142 drives rotation of the pinion 143, the pinion 143 is provided with a trigger 1431, and the trigger 1431 is located beside the bracket 132 of the shield assembly 130 at the lowered position no matter the jaw guard 120 is located at the closed position or the open position. At an initial movement stage of switching the jaw guard 120 from the closed position to the open position or switching the jaw guard 120 from the open position to the closed position, the gearwheel 142 drives the pinion 143 to rotate, and the trigger 1431 is capable of touching the bracket 132 of the shield assembly 130 at the lowered position and raising the shield assembly 130 from the lowered position, so that the shield assembly 130 rotates along a fixed path, and the jaw guard 120 rotates around a fixed axis, thus avoiding interference between the shield assembly 130 and the jaw guard 120 during rotation, and switching the helmet 100 from the full helmet to the half helmet.

The gearwheel 142 and the fork handle 121 may also be manufactured in an integrated structure, so that when the fork handle 121 is rotated, the gearwheel 142 is rotatable with the fork handle 121, so as to ensure that the fork handle 121 is capable of driving the gearwheel 142 to rotate in time during rotation. Similarly, the guide plate 141 and the helmet body 110 may be manufactured in an integrated structure, so that fixation between the guide plate 141 and the helmet body 110 is better.

In an embodiment of the disclosure, with reference to FIG. 10 to FIG. 13, the gearwheel 142 and the pinion 143 are internally engaged with each other. With gear transmission, movement can be transmitted more reliably, which has wide ranges of applicable load and speed, high use efficiency, long service life, compact structure, and small external size. The internal engagement can better reduce a volume of the helmet 100, so that transmission is compact, wearing is small, and a service life is long. The gearwheel 142 and the pinion 143 may also be externally engaged with each other, which can also implement the transmission, and is not limited herein.

Figure 10:
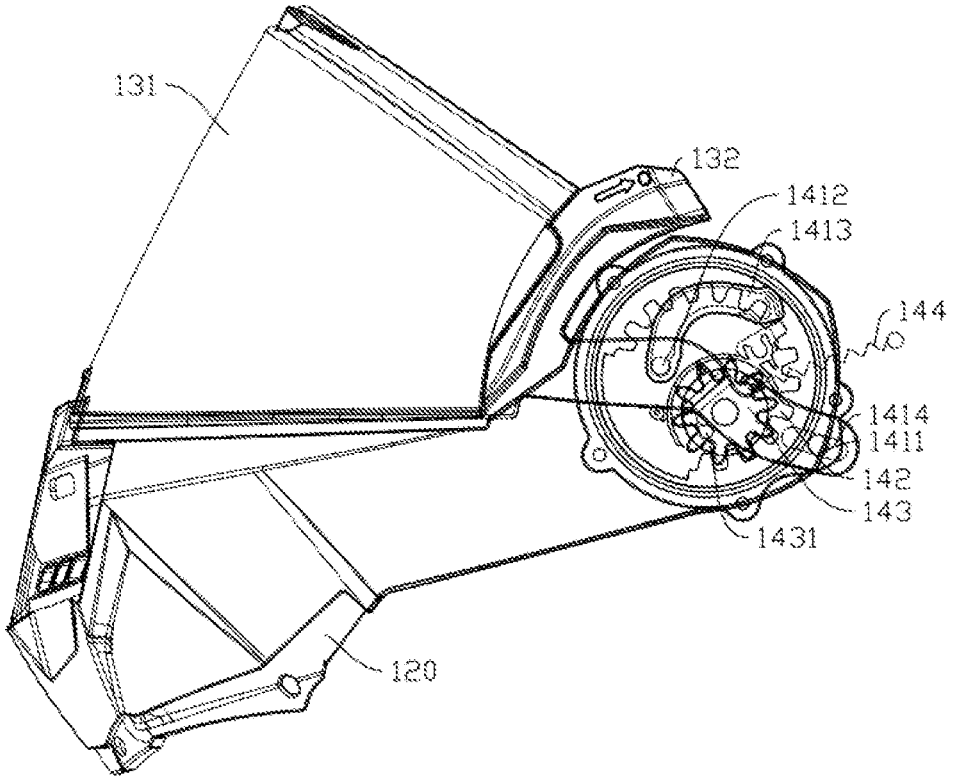
FIG. 10 is a schematic diagram of a matching relationship between the jaw guard and a shield in a full helmet state according to an embodiment of the disclosure.
Figure 11:
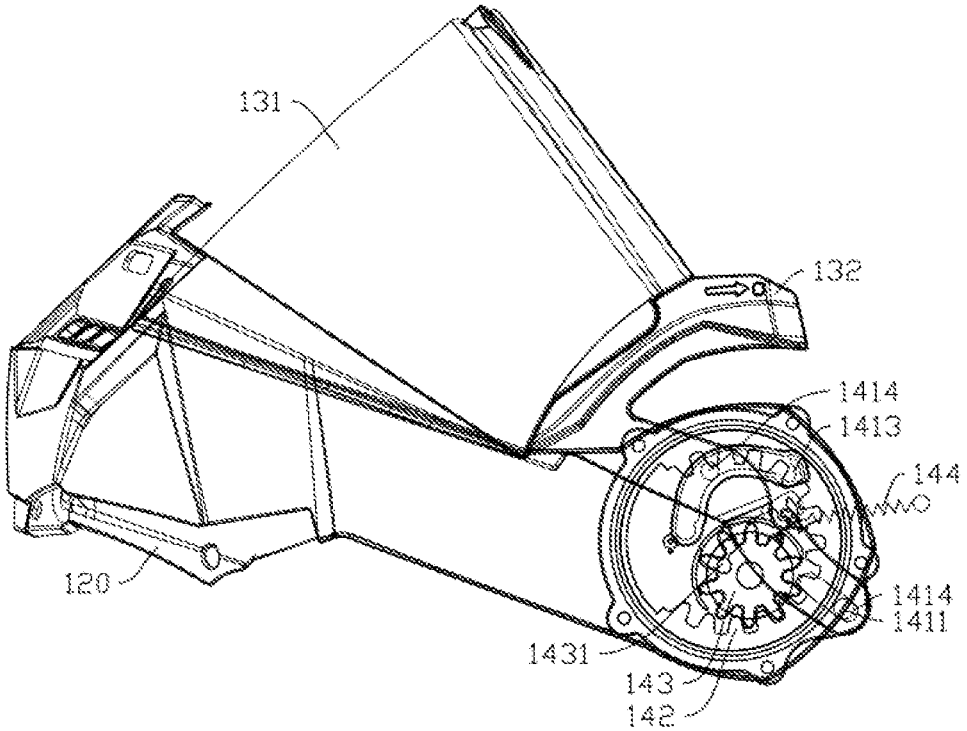
FIG. 11 is a schematic diagram of a matching relationship between the jaw guard and the shield in a state of switching from the full helmet to the half helmet according to an embodiment of the disclosure.
Figure 12:
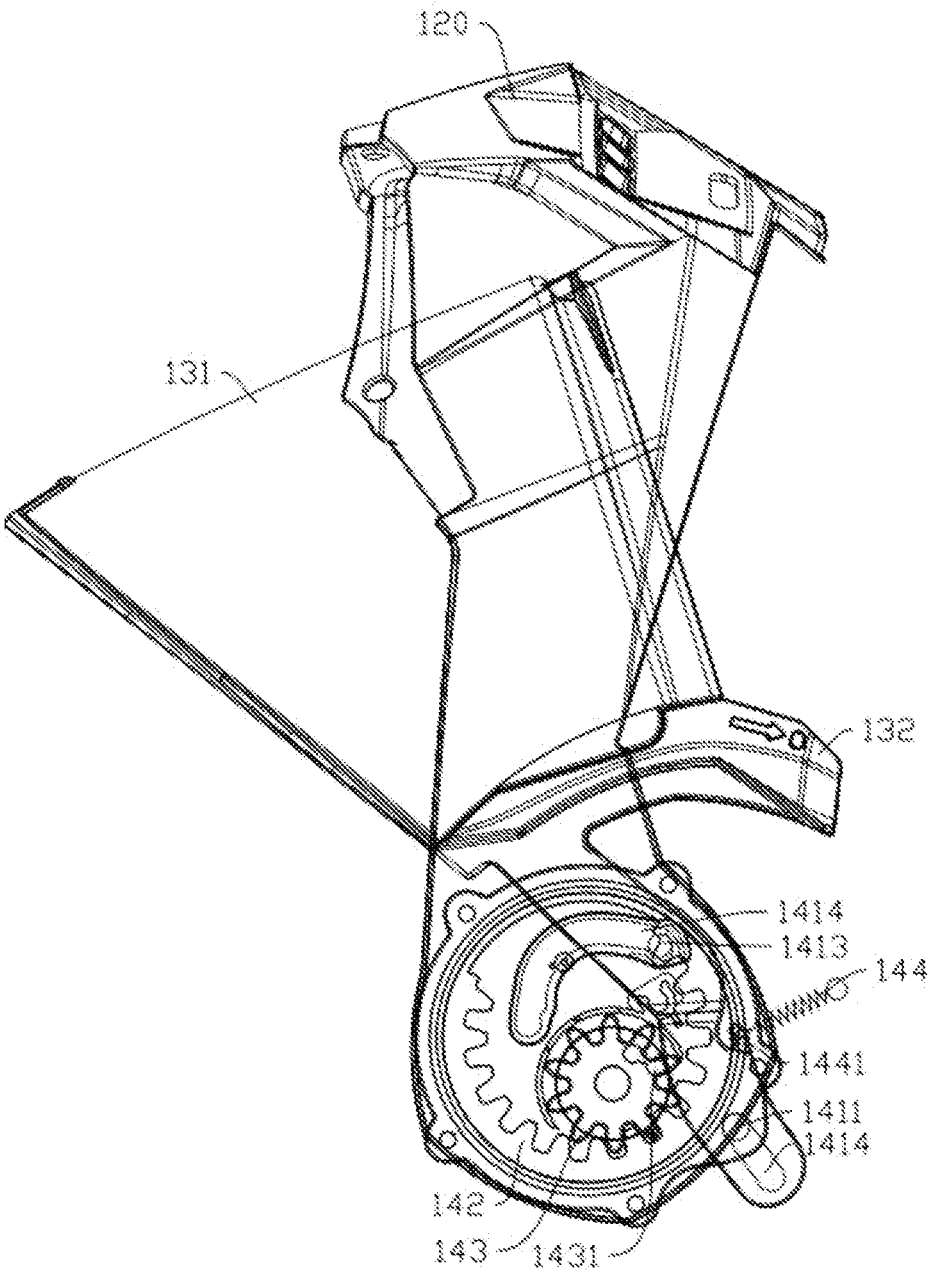
FIG. 12 is a schematic diagram of the matching relationship between the jaw guard and the shield in the state of switching from the full helmet to the half helmet according to an embodiment of the disclosure.

In an embodiment of the disclosure, with reference to FIG. 10 to FIG. 12, when the jaw guard 120 is switched from the closed position to the open position, a forward rotation angle of the pinion 143 driven by the gearwheel 142 is greater than or equal to 270°; and when the jaw guard 120 is switched from the open position to the closed position, a reverse rotation angle of the pinion 143 driven by the gearwheel 142 is greater than or equal to 270°. Whether switching from the closed position to the open position or switching from the open position to the closed position, the rotation angle of the pinion may be 270°, 300°, 330°, 360° and the like, for example, when the jaw guard 120 is switched from the closed position to the open position, the gearwheel 142 drives the pinion 143 to rotate by a turn in a forward direction; and when the jaw guard 120 is switched from the open position to the closed position, the gearwheel 142 drives the pinion 143 to rotate by a turn in a reverse direction. The transmission is simple, reliable and easy to implement, the gearwheel 142 drives the pinion 143 to rotate, the pinion 143 drives the bracket 132 to rotate, and the bracket 132 is fixedly connected with the shield 131, so that the shield 131 is movable according to a defined path of the guide plate 141, thus avoiding the jaw guard 120 from colliding with the shield 131.

Figure 7:
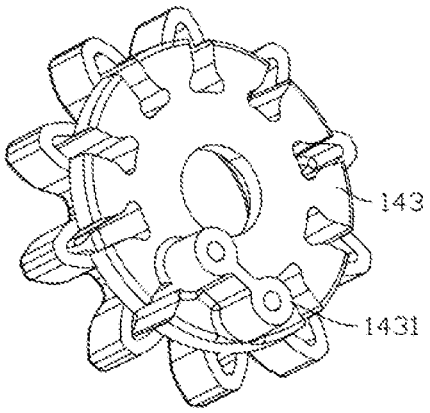
FIG. 7 is a schematic diagram of the pinion according to an embodiment of the disclosure.

In an embodiment of the disclosure, with reference to FIG. 7, the trigger 1431 is at least one deflector rod. The pinion 143 is provided with the trigger 1431, and the trigger 1431 may be one deflector rod or two deflector rods, which is not limited herein. The rotation of the pinion 143 drives rotation of the deflector rod, and the deflector rod is contacted with the bracket 132, so that the deflector rod moves the bracket 132 during rotation. The bracket 132 moves along a specified path of the guide plate 141 due to limitation of the guide plate 141. The deflector rod is simple in structure and reliable in force transmission.

In an embodiment of the disclosure, with reference to FIG. 4 to FIG. 8, the guide assembly includes a guide post and a guide groove matched with each other, and the guide post and the guide groove are respectively mounted on the guide plate 141 and the bracket 132. The guide post and the guide groove are matched with each other, so that the bracket 132 is movable along the specified path of the guide groove.

The guide plate 141 and the bracket 132 located at the same side of the helmet body 110 are provided with two sets of guide assemblies. One set of guide assemblies is configured for limiting a moving path of the shield 131, and the other set of guide assemblies is configured for preventing the bracket 132 from being unstable and deviating when the shield 131 moves. With reference to FIG. 4 to FIG. 8, the guide plate 141 is provided with a first guide groove 1413 and a first guide post 1411, and the bracket 132 is provided with a second guide groove 1414 and a second guide post 1412. The first guide groove 1413 is movably matched with the second guide post 1412, and the second guide groove 1414 is movably matched with the first guide post 1411. The first guide groove 1413 is movably matched with the second guide post 1412, which ensures that the bracket 132 is movable along a designed direction of the first guide groove 1413. It should be noted that a designed path of the first guide groove 1413 refers to a path taken by the shield 131 moving from the lowered position to the raised position, and that is to say, the path referred in this embodiment is to move forward and upward relative to the helmet body 110 first to reach a highest point, and then to move backward and downward. This path is not limited herein, and may be subjected to various changes according to different sizes of the helmet 100 or various needs. The second guide groove 1414 is movably matched with the first guide post 1411, which ensures that the bracket 132 moves stably without deviation, and ensures that the bracket 132 can drive the shield 131 to move stably. The guide post is slidably matched with the guide groove, so that the guide post is movable along the guide groove.

The guide groove of at least one set of guide assemblies is set as V-shaped groove or arc-shaped groove. With reference to FIG. 10 to FIG. 12 and FIGS. 15A-15E, in a full helmet state, when the jaw guard 120 is driven to rotate backward, the gearwheel 142 is driven to rotate, the gearwheel 142 drives the pinion 143 to rotate in a forward direction, and the pinion 143 makes the bracket 132 move. The bracket 132 drives the shield 131 to move along the specified path of the first guide groove 1413, which is to move upward and forward first to reach the highest point, and then to move downward and backward to be close to the helmet body 110, so that the shield 131 is close to the helmet body 110 and far away from the jaw guard 120. Therefore, a certain gap is generated between the shield 131 and the jaw guard 120, and the jaw guard 120 rotates around a fixed axis, and can smoothly rotate over the shield 131, thus switching the helmet from the full helmet to the half helmet. With reference to FIG. 10 to FIG. 12 and FIGS. 16A-16E, in a half helmet state, when the shield 131 is driven to rotate forward, the gearwheel 142 is driven to rotate, the gearwheel 142 drives the pinion 143 to rotate in a reverse direction, and the pinion 143 makes the bracket 132 move. The bracket 132 drives the shield 131 to move upward and forward first to reach the highest point, and then to move downward and backward to be close to the helmet body 110, so that the shield 131 is close to the helmet body 110 and far away from the jaw guard 120. Therefore, a certain gap is generated between the shield 131 and the jaw guard 120, and the jaw guard 120 rotates around a fixed axis, and can smoothly rotate over the shield 131, thus switching the helmet from the half helmet to the full helmet.

In an embodiment of the disclosure, with reference to FIG. 10 to FIG. 12, the lifting mechanism 140 further includes an elastic element 144, one end of the elastic element 144 is connected with the bracket 132, and the elastic element 144 is configured to make the shield assembly 130 continue to move to the raised position after the shield assembly 130 leaves the lowered position. The elastic element 144 provides an elastic force for the movement of the bracket 132, which makes the bracket 132 rotate faster, and makes the bracket 132 continue to move to the raised position along a specified direction of the guide plate 141 after being separated from the pinion 143 at the same time, thus switching the bracket from the lowered position to the raised position. The elastic element may be a spring, a tension spring and the like, with a simple structure and a high stability.

Figure 8:
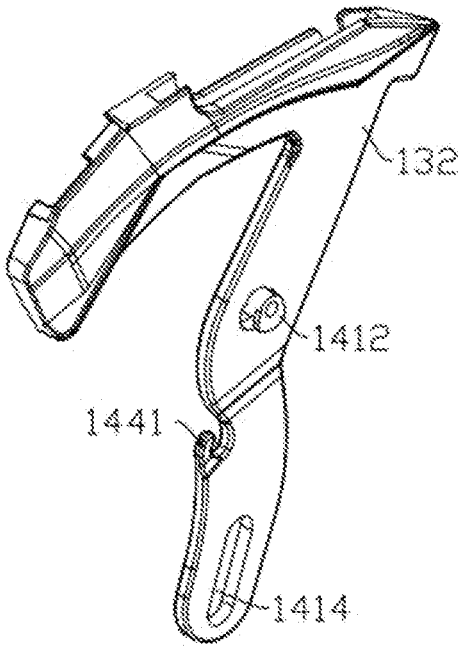
FIG. 8 is a schematic diagram of the bracket according to an embodiment of the disclosure.

In an embodiment of the disclosure, as shown in FIG. 8, the bracket 132 is provided with a draw hook 1441 for hooking the tension spring, which facilitates connection of the bracket 132 with the tension spring, and also facilitates replacement or disassembly of the tension spring after being damaged.

Figure 9:
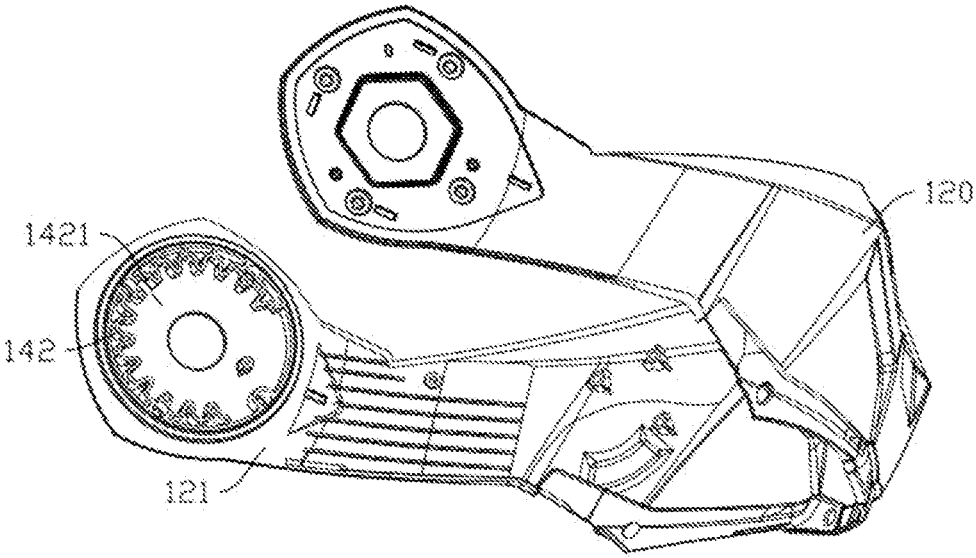
FIG. 9 is a schematic diagram of matching between a jaw guard and a gearwheel according to an embodiment of the disclosure.

In an embodiment of the disclosure, as shown in FIG. 9, the gearwheel 142 is arranged on a turntable 1421, and the turntable 1421 is fixedly mounted on the fork handle 121. The gearwheel 142 is provided with the turntable 1421, and the turntable 1421 is fixedly connected with the fork handle 121, so that the gearwheel 142 is fixedly connected with the turntable 1421, the structure is easy to implement, the manufacturing is simple and reasonable, and the fork handle 121 or the gearwheel 142 can also be replaced or disassembled.

In an embodiment of the disclosure, as shown in FIG. 2, the lifting mechanism 140 further includes a chassis cover 145 for covering the lifting mechanism 140, and the chassis cover 145 is fixedly connected with the fork handle 121, thus avoiding dust, rainwater and other pollutants from entering the helmet 100 to damage the lifting mechanism 140, better protecting the lifting mechanism 140, and prolonging a service life of the helmet 100.

Figure 13:
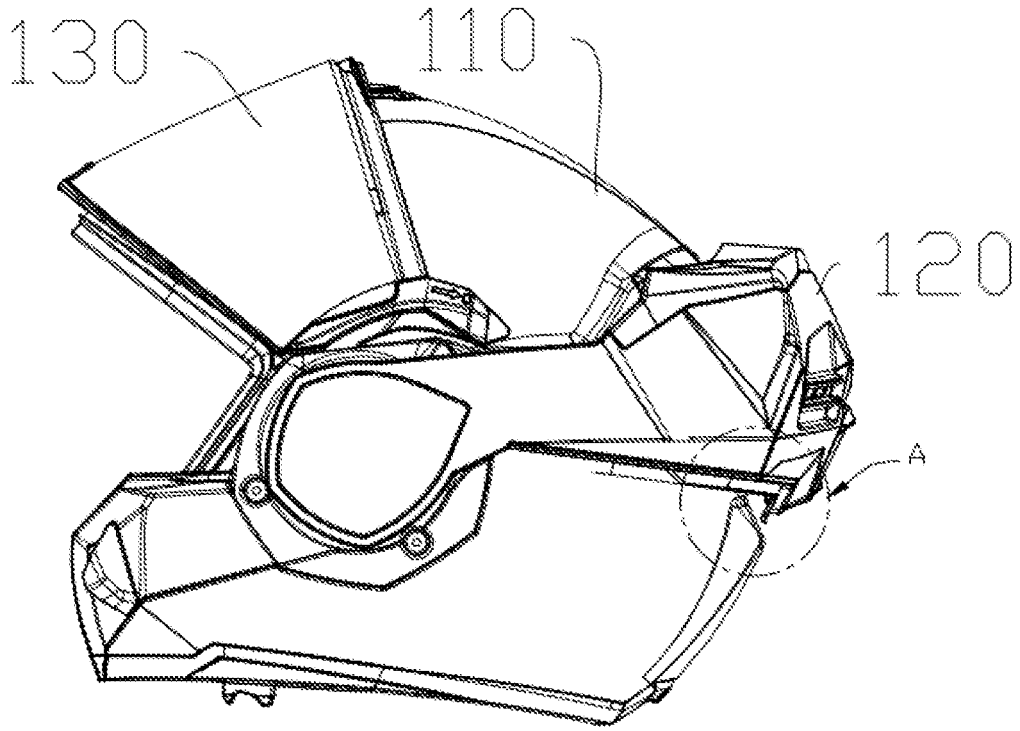
FIG. 13 is a schematic diagram of the helmet in a half helmet state according to an embodiment of the disclosure.
Figure 14:
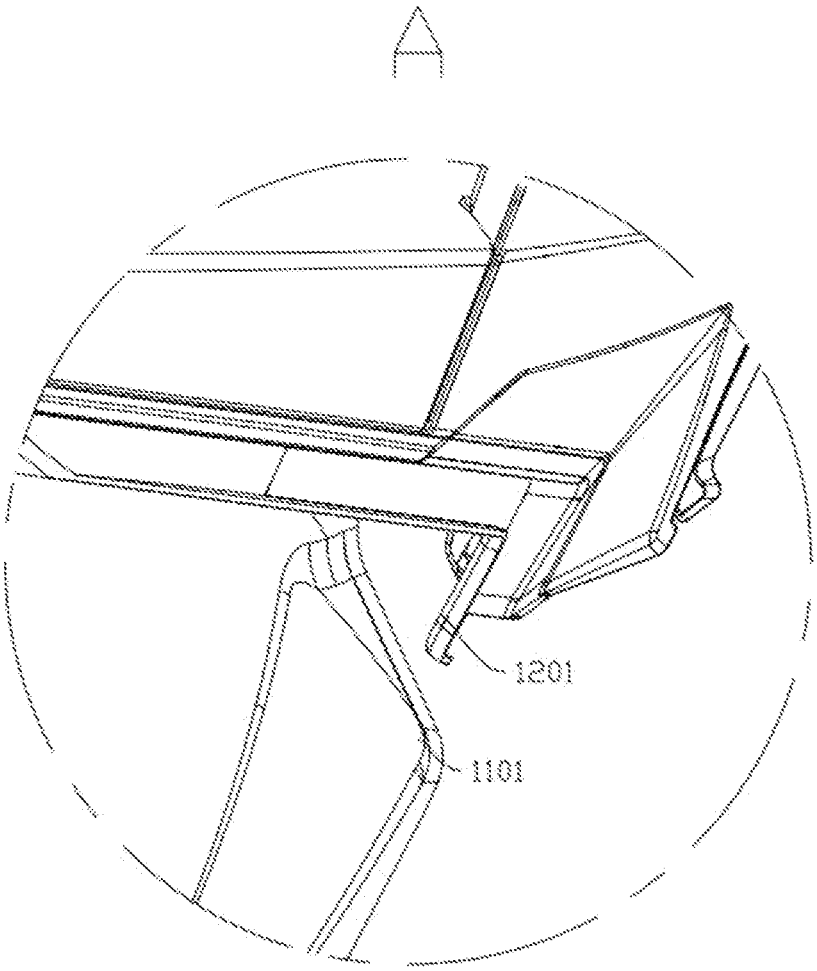
FIG. 14 is a locally enlarged view of a part A in FIG. 13.

In an embodiment of the disclosure, as shown in FIG. 13 and FIG. 14, the jaw guard 120 is provided with a first limiting portion 1201, the helmet body 110 is provided with a second limiting portion 1101, and the second limiting portion 1101 is matched with the first limiting portion 1201 for limiting a rotation position of the jaw guard 120 relative to the helmet body 110. Therefore, the rotation angle of the jaw guard 120 is better limited, thus avoiding excessive rotation of the jaw guard 120 due to overexertion to damage the helmet 100. Meanwhile, the jaw guard 120 can also be well fixed, so that the jaw guard 120 is stationary relative to the helmet body 110 in the half helmet state, thus being safer.

The first limiting portion 1201 is one of a bulge and a groove, and the second limiting portion 1101 is the other of the bulge and the groove. The groove and the bulge are simple in structure and convenient to manufacture, and meanwhile, the bulge is in snap fit with the groove, thus being convenient for a user to use.

Figure 3:
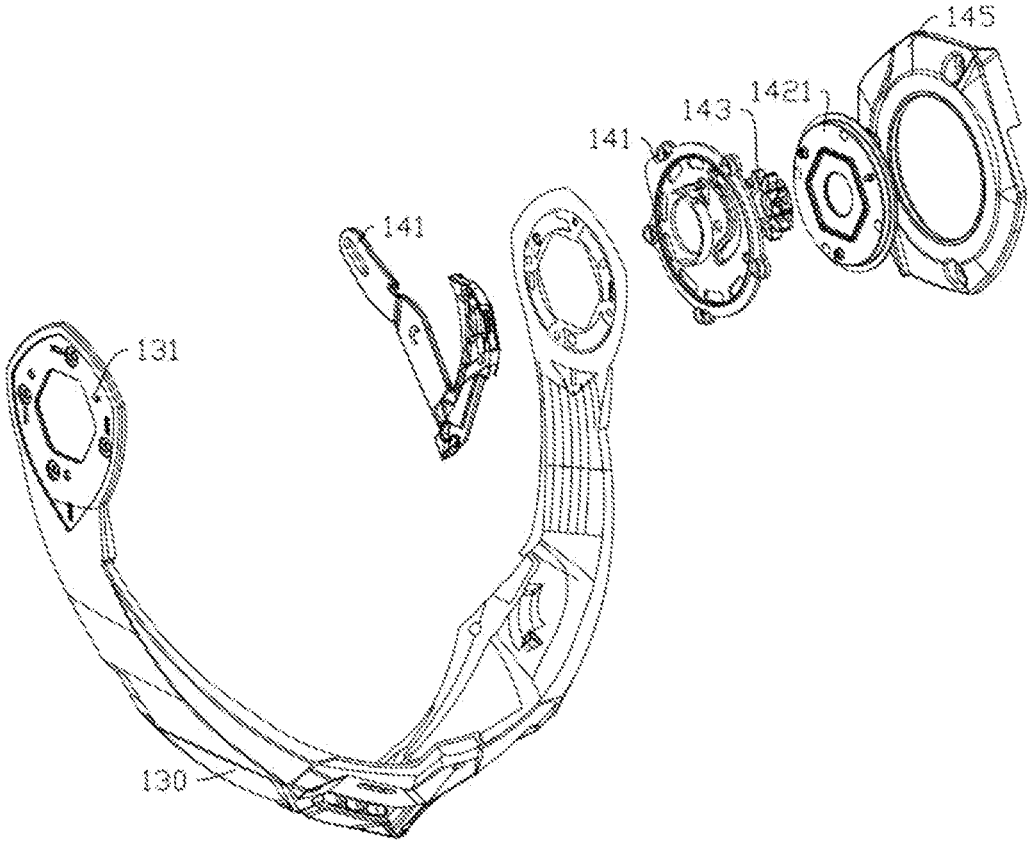
FIG. 3 is an exploded view of a lifting mechanism of the helmet according to an embodiment of the disclosure.

With reference to FIG. 1 to FIG. 3, an embodiment in a second aspect of the disclosure also provides another helmet 100. The helmet 100 includes a helmet body 110, a jaw guard 120, a shield assembly 130 and a lifting mechanism 140. The jaw guard 120 is provided with two fork handles 121, the two fork handles 121 are respectively mounted at two sides of the helmet body 110, the jaw guard 120 is mounted on the helmet body 110 through the two fork handles 121 and is rotatable around a fixed axis relative to the helmet body 110, so that the jaw guard 120 is movable between a closed position in front of the helmet body 110 and an open position behind the helmet body 110 and beyond a vertex of the helmet body 110. The shield assembly 130 includes a shield 131 and brackets 132 arranged at two sides of the shield 131, an end portion of the bracket 132 far away from the shield 131 is hinged on the helmet body 110, the shield assembly 130 is rotatable around a hinged position, and is movable between a lowered position and a raised position relative to the helmet body 110. The lifting mechanism 140 includes a trigger 1431, and the trigger 1431 is located beside the bracket 132 of the shield assembly 130 at the lowered position no matter the jaw guard 120 is located at the closed position or the open position. At an initial movement stage of switching the jaw guard 120 from the closed position to the open position or switching the jaw guard 120 from the open position to the closed position, the trigger 1431 is capable of touching the bracket 132 of the shield assembly 130 at the lowered position and raising the shield assembly 130 from the lowered position, thus switching the helmet 100 from the full helmet to the half helmet.

Figure 4:
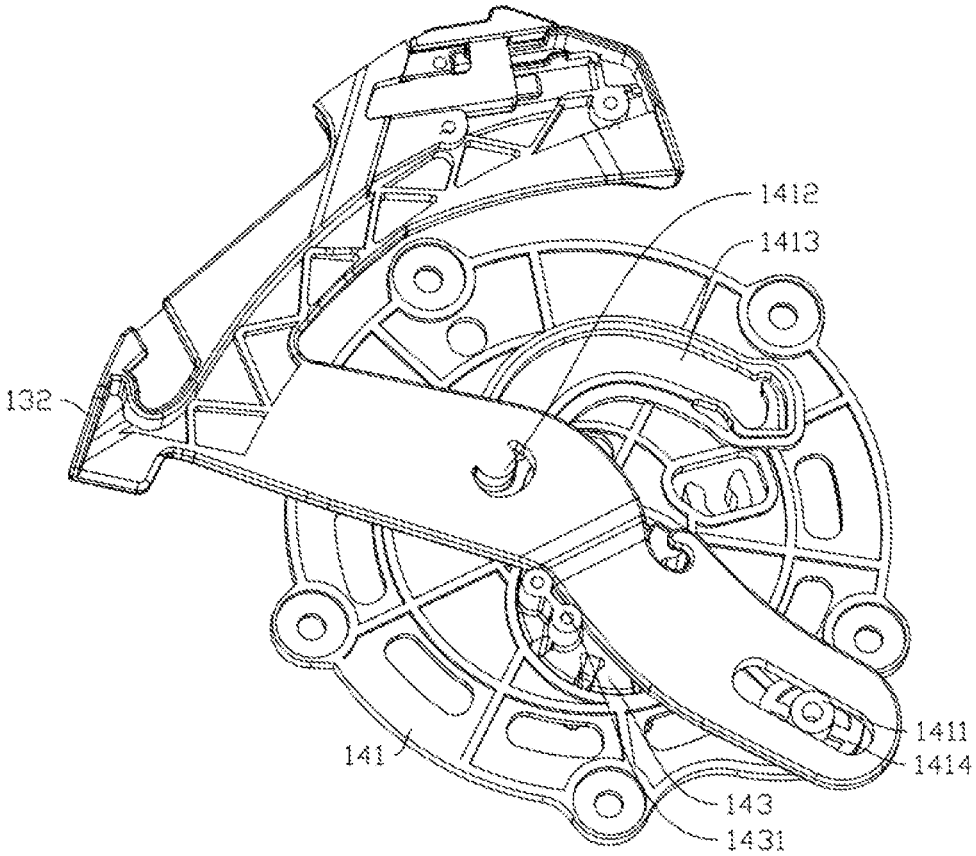
FIG. 4 is a schematic diagram of matching of a bracket, a pinion and a guide plate according to an embodiment of the disclosure.
Figure 5:
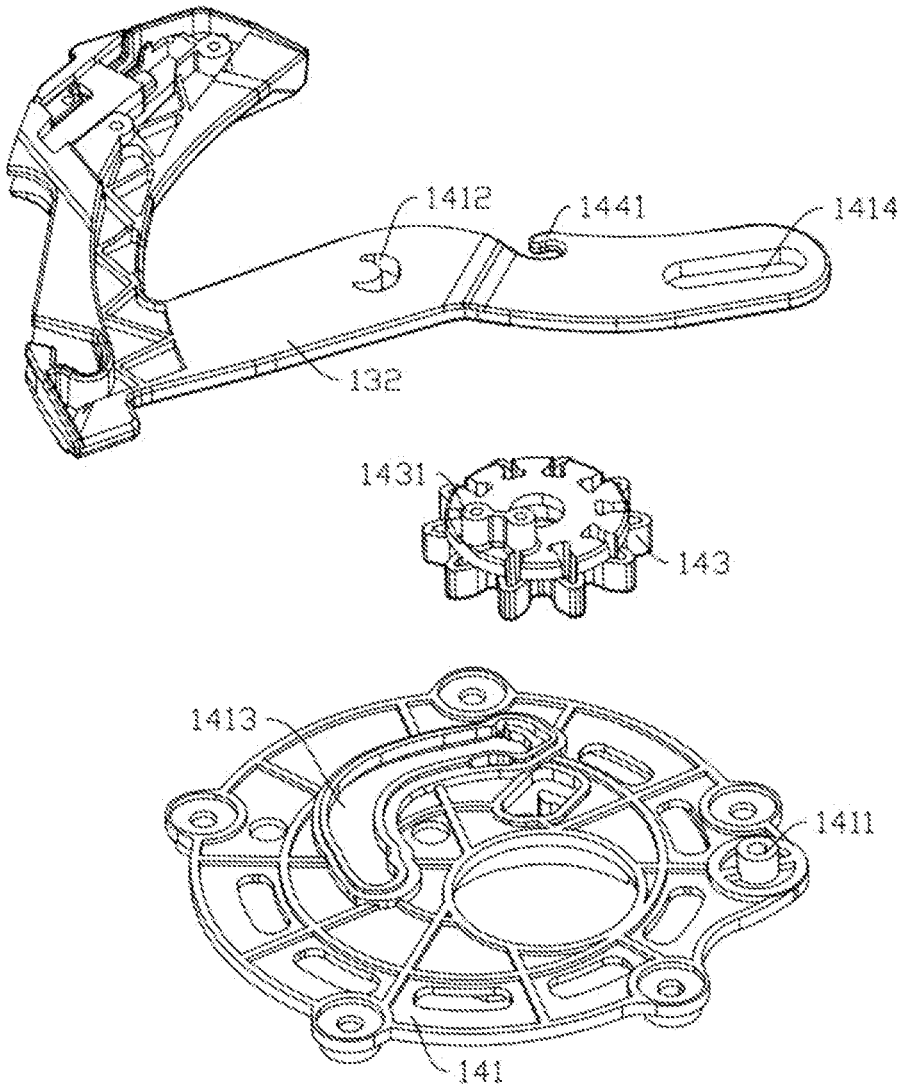
FIG. 5 is an exploded view of the matching of the bracket, the pinion and the guide plate in FIG. 4.
Figure 6:
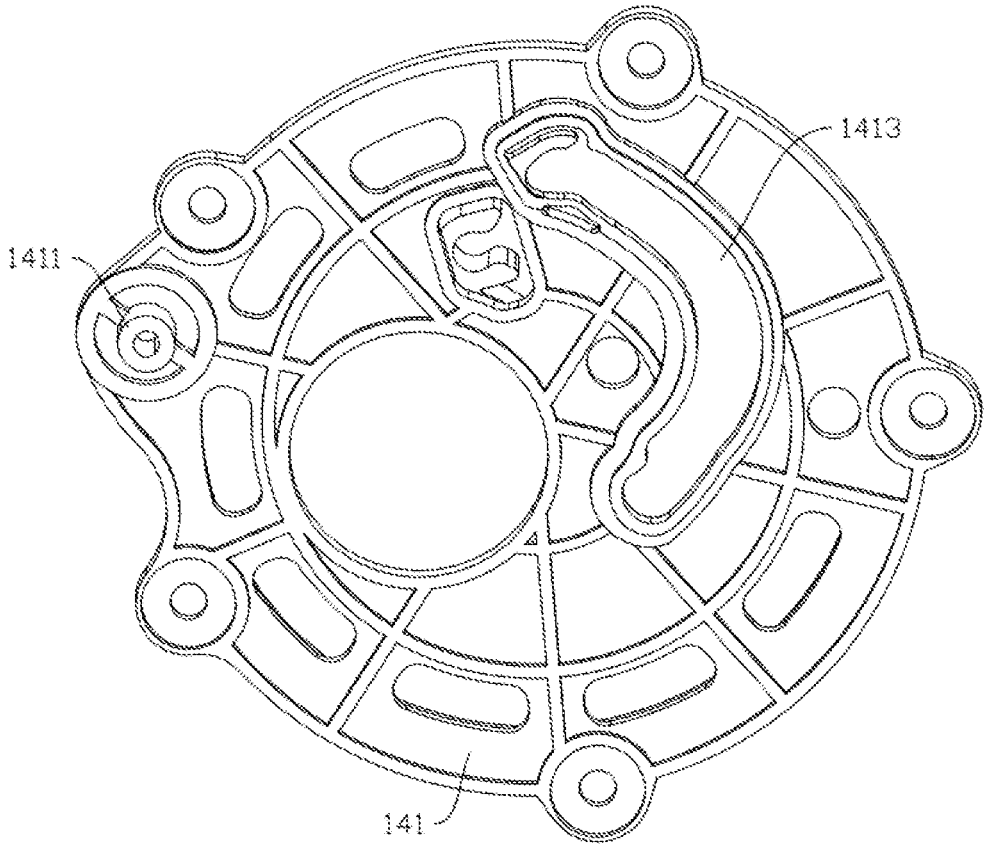
FIG. 6 is a schematic diagram of the guide plate according to an embodiment of the disclosure.

In an embodiment of the disclosure, with reference to FIG. 4, FIG. 5 and FIG. 7, the trigger 1431 is a deflector rod. The deflector rod has a simple structure, the lifting mechanism 140 drives the deflector rod to rotate during rotation, and the deflector rod pushes the bracket 132 to move, so that the shield assembly 130 is movable from the lowered position to the raised position.

In an embodiment of the disclosure, with reference to FIG. 10 to FIG. 12, the lifting mechanism 140 further includes an elastic element 144, one end of the elastic element 144 is connected with the bracket 132, and the elastic element 144 is configured to make the shield assembly 130 continue to move to the raised position after the shield assembly 130 leaves the lowered position. The elastic element 144 provides an elastic force for the movement of the bracket 132, which makes the bracket 132 rotate faster, and makes the bracket 132 continue to move to the raised position along a specified direction of the guide plate 141 after being separated from the pinion 143 at the same time, thus switching the bracket from the lowered position to the raised position.

The elastic element may be a spring, a tension spring and the like, with a simple structure and a high stability.

In an embodiment of the disclosure, as shown in FIG. 8, the bracket 132 is provided with a draw hook 1441 for hooking the tension spring, which facilitates connection of the bracket 132 with the tension spring, and also facilitates replacement or disassembly of the tension spring after being damaged.

Figure 15C:
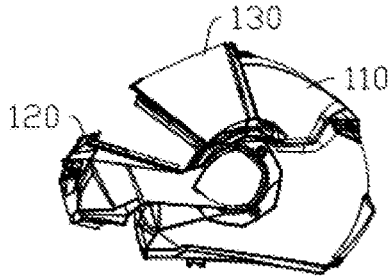
FIGS. 15A-15E are schematic diagram of switching from the full helmet to the half helmet according to an embodiment of the disclosure.
Figure 15D:
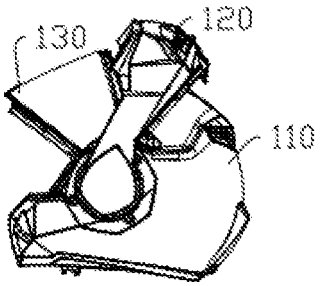
Figure 15B:
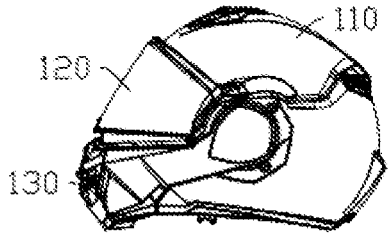
Figure 15E:
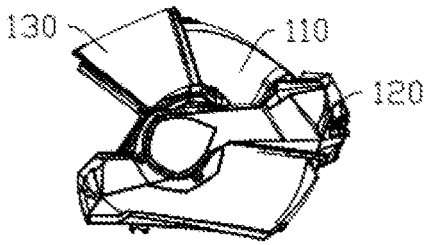
Figure 15A:
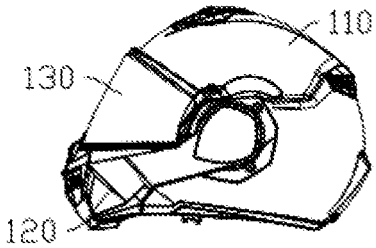
Figure 16C:
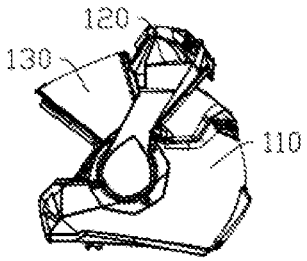
FIGS. 16A-16E are schematic diagram of switching from the half helmet to the full helmet according to an embodiment of the disclosure.
Figure 16B:
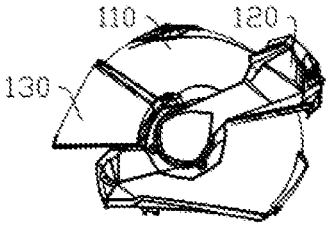
Figure 16D:
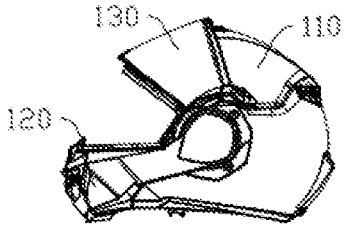
Figure 16A:
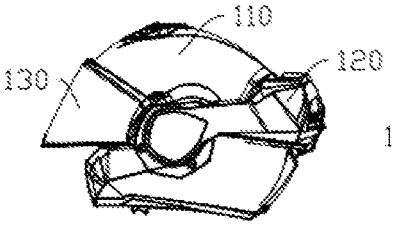
Figure 16E:
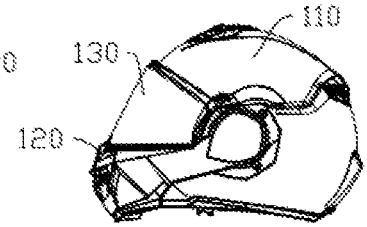

In a specific embodiment, with reference to FIGS. 15A-15E, from FIG. 15A to FIG. 15B, the jaw guard 120 is opened and starts to be driven to rotate. Since a size of the pinion 143 is smaller than that of the gearwheel 142, it is ensured that the jaw guard 120 does not move beyond the shield 131, i.e., the jaw guard 120 moves behind the shield 131, before the shield 131 is close to the helmet body 110. From FIG. 15B to FIG. 15C, the jaw guard 120 rotates, and the gearwheel 142 rotates with the jaw guard 120 at the same time as the jaw guard 120 is fixedly connected with the gearwheel 142. Rotation of the gearwheel 142 causes rotation of the pinion 143 by means of gear transmission. The pinion 143 is provided with the deflector rod, and the bracket 132 fixedly connected with the shield 131 is movably matched with the pinion 143, and is also matched with the deflector rod at the same time. The rotation of the pinion 143 drives the rotation of the deflector rod, and the deflector rod pushes the bracket 132 to move. However, since the second guide post 1412 of the bracket 132 is movably matched with the first guide groove 1413 of the guide plate 141, the bracket 132 moves in the designed direction of the first guide groove 1413, which is to move upward and forward first to reach the highest point, and then to move downward and backward to be close to the helmet body 110. From FIG. 15C to FIG. 15D, the jaw guard 120 rotates over the shield 131, and then continues to rotate, with reference to FIG. 15E, until the first limiting portion 1201 of the jaw guard 120 is connected with the second limiting portion 1101 of the helmet body 110, and the jaw guard 120 is fixed on the helmet body 110, thus switching the helmet from the full helmet to the half helmet. At the moment, if the shield 131 is needed, the shield 131 may be deflected down manually. With reference to FIGS. 16A-16E, from FIG. 16A to FIG. 16B, in the half helmet state, the first limiting portion 1201 and the second limiting portion 1101 are opened in a fixed connection state, the jaw guard 120 starts to be driven to rotate. From FIG. 16B to FIG. 16C, the jaw guard 120 rotates, and the gearwheel 142 rotates with the jaw guard 120 at the same time as the jaw guard 120 is fixedly connected with the gearwheel 142. Rotation of the gearwheel 142 causes rotation of the pinion 143 by means of gear transmission. The pinion 143 is provided with the deflector rod, and the bracket 132 fixedly connected with the shield 131 is movably matched with the pinion 143, and is also matched with the deflector rod at the same time. The rotation of the pinion 143 drives the rotation of the deflector rod, and the deflector rod pushes the bracket 132 to move. However, since the second guide post 1412 of the bracket 132 is movably matched with the first guide groove 1413 of the guide plate 141, the guide plate 141 is fixed on the chassis cover 145, and the chassis cover 145 is fixed on the helmet body 110, the bracket 132 will move in the designed direction of the first guide groove 1413, which is to move upward and forward first to reach the highest point, and then to move downward and backward to be close to the helmet body 110. From FIG. 16C to FIG. 16D, the shield 131 rotates over the helmet body 110, and then continues to rotate to return to a position in which the helmet is in the full helmet state, and then the shield 131 is deflected down, thus switching the helmet from the half helmet to the full helmet.

The embodiments of the disclosure are described in detail with reference to the drawings above, but the disclosure is not limited to the above embodiments, and various changes may also be made within the knowledge scope of those of ordinary skills in the art without departing from the purpose of the disclosure.

What is claimed is:

1. A helmet, comprising:

a helmet body;

a jaw guard, wherein the jaw guard is provided with two fork handles, the jaw guard is mounted on the helmet body through the two fork handles and is rotatable around a fixed axis relative to the helmet body, and the jaw guard is movable between a closed position in front of the helmet body and an open position behind the helmet body and beyond a vertex of the helmet body;

a shield assembly movably mounted on the helmet body, wherein the shield assembly is movable between a lowered position and a raised position relative to the helmet body, and the shield assembly comprises a shield and brackets arranged at two sides of the shield; and a lifting mechanism, wherein the lifting mechanism comprises:

a guide plate, wherein the guide plate is mounted on the helmet body, or the guide plate and the helmet body are manufactured in an integrated structure, the guide plate is configured for guiding and limiting movement of the shield assembly, and the guide plate and the bracket are provided with respective guide assemblies which are matched with each other;

a gearwheel, wherein the gearwheel is mounted on one of the fork handles of the jaw guard, or the gearwheel and the fork handle on the jaw guard are manufactured in an integrated structure, and the gearwheel is rotatable with the jaw guard; and a pinion engaged with the gearwheel, wherein the pinion is provided with a trigger, and the trigger is located beside the bracket of the shield assembly at the lowered position no matter the jaw guard is located at the closed position or the open position;

wherein, at an initial movement stage of switching the jaw guard from the closed position to the open position or switching the jaw guard from the open position to the closed position, the gearwheel drives the pinion to rotate, and the trigger is capable of touching the bracket of the shield assembly at the lowered position and raising the shield assembly from the lowered position.

2. The helmet of claim 1, wherein the gearwheel and the pinion are internally engaged with each other.

3. The helmet of claim 1, wherein the gearwheel and the pinion are externally engaged with each other.

4. The helmet of claim 1, wherein the gearwheel and the pinion are both rotatable around a fixed axis relative to the helmet body.

5. The helmet of claim 4, wherein when the jaw guard is switched from the closed position to the open position, a forward rotation angle of the pinion is greater than or equal to 270°; and when the jaw guard is switched from the open position to the closed position, a reverse rotation angle of the pinion is greater than or equal to 270°.

6. The helmet of claim 1, wherein the trigger is at least one deflector rod.

7. The helmet of claim 1, wherein the guide assembly comprises a guide post and a guide groove matched with each other, and the guide post and the guide groove are respectively mounted on the guide plate and the bracket.

8. The helmet of claim 7, wherein the guide plate and the bracket located at a same side of the helmet body are provided with two sets of guide assemblies.

9. The helmet of claim 8, wherein the guide groove of at least one set of guide assemblies is set as V-shaped groove or arc-shaped groove.

10. The helmet of claim 1, wherein the lifting mechanism further comprises an elastic element, one end of the elastic element is connected with the bracket, and the elastic element is configured to make the shield assembly continue to move to the raised position after the shield assembly leaves the lowered position.

11. The helmet of claim 10, wherein the elastic element is a tension spring.

12. The helmet of claim 11, wherein the bracket is provided with a draw hook for hooking the tension spring.

13. The helmet of claim 1, wherein the gearwheel is arranged on a turntable, and the turntable is fixedly mounted on the fork handle.

14. The helmet of claim 1, wherein the lifting mechanism further comprises a chassis cover for covering the lifting mechanism, and the chassis cover is fixedly connected with the fork handle.

15. The helmet of claim 1, wherein the jaw guard is provided with a first limiting portion, the helmet body is provided with a second limiting portion, and the second limiting portion is matched with the first limiting portion for limiting a rotation position of the jaw guard relative to the helmet body.

16. The helmet of claim 15, wherein the first limiting portion is one of a bulge and a groove, and the second limiting portion is the other of the bulge and the groove.

17. A helmet, comprising:

a helmet body;

a jaw guard, wherein the jaw guard is provided with two fork handles, the jaw guard is mounted on the helmet body through the two fork handles and is rotatable around a fixed axis relative to the helmet body, and the jaw guard is movable between a closed position in front of the helmet body and an open position behind the helmet body and beyond a vertex of the helmet body;

a shield assembly, wherein the shield assembly comprises a shield and brackets arranged at two sides of the shield, an end portion of each of the brackets far away from the shield is hinged on the helmet body, the shield assembly is rotatable around a hinged position, and the shield assembly is movable between a lowered position and a raised position relative to the helmet body; and a lifting mechanism, wherein the lifting mechanism comprises a trigger, and the trigger is located beside the bracket of the shield assembly at the lowered position no matter the jaw guard is located at the closed position or the open position;

wherein, at an initial movement stage of switching the jaw guard from the closed position to the open position or switching the jaw guard from the open position to the closed position, the trigger is capable of touching the bracket of the shield assembly at the lowered position and raising the shield assembly from the lowered position.

18. The helmet of claim 17, wherein the trigger is a deflector rod.

19. The helmet of claim 17, wherein the lifting mechanism further comprises an elastic element, one end of the elastic element is connected with the bracket, and the elastic element is configured to make the shield assembly continue to move to the raised position after the shield assembly leaves the lowered position.

20. The helmet of claim 19, wherein the elastic element is a tension spring.

21. The helmet of claim 20, wherein the bracket is provided with a draw hook for hooking the tension spring.

* * * * *